US007586244B2

(12) United States Patent
Ritz et al.

(10) Patent No.: US 7,586,244 B2
(45) Date of Patent: Sep. 8, 2009

(54) ULTRA-HIGH PRESSURE DISCHARGE LAMP PROVIDED WITH A MULTI-LAYERED INTERFERENCE FILTER ON AN OUTER SURFACE OF THE LAMP

(75) Inventors: Arnd Ritz, Heinsberg (DE); Holger Mönch, Vaals (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 438 days.

(21) Appl. No.: 10/556,112

(22) PCT Filed: May 4, 2004

(86) PCT No.: PCT/IB2004/001510

§ 371 (c)(1),
(2), (4) Date: Nov. 8, 2005

(87) PCT Pub. No.: WO2004/100210

PCT Pub. Date: Nov. 18, 2004

(65) Prior Publication Data

US 2008/0054774 A1 Mar. 6, 2008

(30) Foreign Application Priority Data

May 12, 2003 (EP) ..... 03101303

(51) Int. Cl.
*H01J 61/38* (2006.01)
*H01J 61/40* (2006.01)
*H01J 61/35* (2006.01)
*H01J 17/16* (2006.01)

(52) U.S. Cl. ..... 313/112; 313/489; 313/635

(58) Field of Classification Search ..... 313/25, 313/489, 635, 568, 112
See application file for complete search history.

(56) References Cited

U.S. PATENT DOCUMENTS 5,221,876 A 6/1993 Bergman et al.
5,608,227 A * 3/1997 Dierks et al. ..... 250/492.1
5,610,469 A * 3/1997 Bergman et al. ..... 313/25
2003/0077459 A1 * 4/2003 Vitt et al. ..... 428/432

FOREIGN PATENT DOCUMENTS

EP 727813 A2 * 8/1996
WO WO 03100820 A2 * 12/2003

* cited by examiner

*Primary Examiner*—Mariceli Santiago

(57) ABSTRACT

The invention relates to a high-pressure discharge lamp which comprises at least a burner (2) having a symmetrical discharge chamber (21), where at least the outer contour of the burner (2) has an elliptical shape in the region of the discharge chamber (21), two electrodes (41, 42) extending into the discharge chamber (21) and arranged in mutual opposition on the major axis of symmetry of the discharge chamber (21), and a multilayer interference filter (3) arranged on the outer contour of the burner (2) in the region of the discharge chamber (21), wherein the interference filter (3) mainly reflects light from at least one wavelength range of the UV light into the space between the two electrodes (41, 42).

17 Claims, 2 Drawing Sheets

| Layer Substrate | Material Quartz | Thickness ( nm ) |
|---|---|---|
| 1 | $SiO_2$ | 57.76 |
| 2 | $ZrO_2$ | 27.64 |
| 3 | $SiO_2$ | 58.10 |
| 4 | $ZrO_2$ | 45.50 |
| 5 | $SiO_2$ | 57.63 |
| 6 | $ZrO_2$ | 43.72 |
| 7 | $SiO_2$ | 65.26 |
| 8 | $ZrO_2$ | 42.80 |
| 9 | $SiO_2$ | 58.54 |
| 10 | $ZrO_2$ | 46.85 |
| 11 | $SiO_2$ | 67.19 |
| 12 | $ZrO_2$ | 38.65 |
| 13 | $SiO_2$ | 54.36 |
| 14 | $ZrO_2$ | 50.95 |
| 15 | $SiO_2$ | 85.52 |
| 16 | $ZrO_2$ | 9.68 |
| 17 | $SiO_2$ | 170.30 |
| | | |

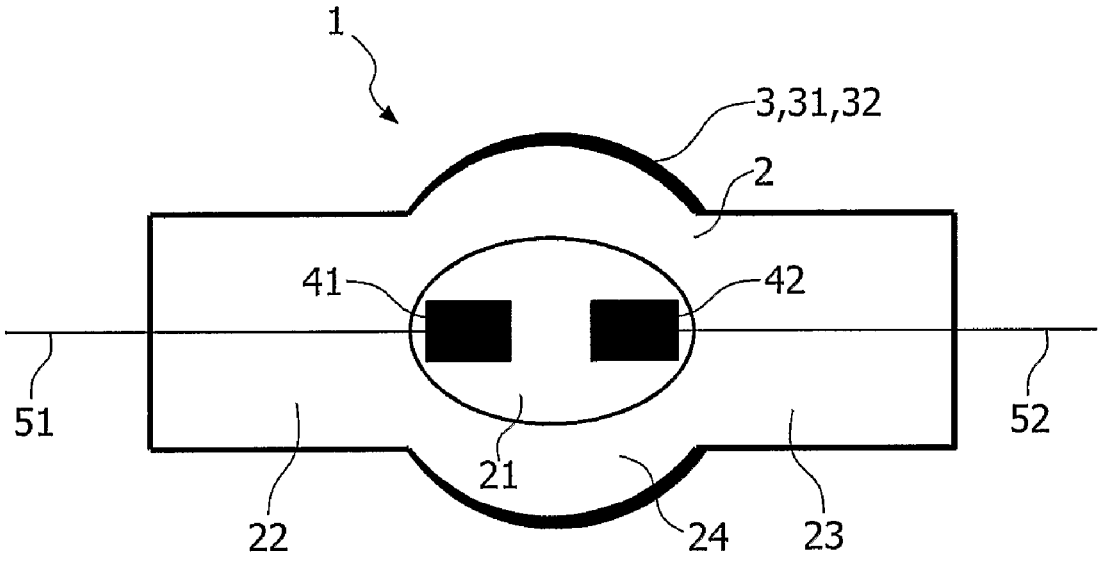
FIG. 1.1

| Layer Substrate | Material Quartz | Thickness ( nm ) |
|---|---|---|
| 1 | $SiO_2$ | 57.76 |
| 2 | $ZrO_2$ | 27.64 |
| 3 | $SiO_2$ | 58.10 |
| 4 | $ZrO_2$ | 45.50 |
| 5 | $SiO_2$ | 57.63 |
| 6 | $ZrO_2$ | 43.72 |
| 7 | $SiO_2$ | 65.26 |
| 8 | $ZrO_2$ | 42.80 |
| 9 | $SiO_2$ | 58.54 |
| 10 | $ZrO_2$ | 46.85 |
| 11 | $SiO_2$ | 67.19 |
| 12 | $ZrO_2$ | 38.65 |
| 13 | $SiO_2$ | 54.36 |
| 14 | $ZrO_2$ | 50.95 |
| 15 | $SiO_2$ | 85.52 |
| 16 | $ZrO_2$ | 9.68 |
| 17 | $SiO_2$ | 170.30 |
| | | |

FIG. 1.2

ULTRA-HIGH PRESSURE DISCHARGE LAMP PROVIDED WITH A MULTI-LAYERED INTERFERENCE FILTER ON AN OUTER SURFACE OF THE LAMP

This application is a 371 U.S. National Stage filing of PCT/IB04/015010, filed May 4, 2004, which claims priority to European Patent Application Number 03101303, filed May 12, 2003, which are incorporated herein by reference.

The invention relates to a high-pressure discharge lamp, at least with a burner having a symmetrical discharge chamber, wherein at least the outer contour of the burner has an elliptical shape, with two electrodes extending into the discharge chamber and arranged in mutual opposition on the major axis of symmetry of the discharge chamber, and with at least one multilayer interference filter which is provided on the outer contour of the burner in the region of the discharge chamber.

High-pressure gas discharge lamps (HID or high intensity discharge lamps) and in particular UHP (ultra high performance) lamps are used by preference for projection purposes because of their optical properties. The expression UHP lamp (Philips) also denotes UHP-type lamps from other manufacturers within the scope of the invention.

A light source which is as point-shaped as possible is required for the above applications, i.e. the discharge arc formed between the electrode tips must not exceed a certain length. Furthermore, as high as possible a luminous intensity is desired in combination with as natural as possible a spectral composition of the visible light.

Although high-pressure gas discharge lamps have an improved luminous efficacy, for example compared with incandescent lamps, a further improvement of their efficacy is at the center of the development efforts relating to high-pressure gas discharge lamps.

The luminous efficacy of a light source is generally impaired inter alia by the situation that, besides the radiation in the wavelength range desired for the application, radiation is regularly emitted which is not useful or even harmful for this application. This undesirable radiation leads at least to a loss of input energy in relation to the envisaged result.

For example, the major portion of the light emitted by an incandescent lamp is IR light, which is useless for general lighting purposes in the visible range and accordingly detracts from the relevant luminous efficacy.

With UHP lamps, no more than approximately 25 W out of every 100 W of the electrical power supplied to the lamp is actually converted into visible radiation.

A basic solution principle for increasing the luminous efficacy is known from U.S. Pat. No. 5,221,876, i.e. in that undesirable IR radiation is reflected back into the region of the lamp bulb so as to provide the latter with additional heating. A multilayer interference filter serves as a reflector. The IR (infrared) light of the emitted spectrum, which would otherwise not be used for illumination purposes, is now reflected back to the lamp bulb and re-absorbed.

It is suggested at the same time to absorb any UV radiation present in the interference filter, in particular for preventing damage to lamp components caused by this radiation.

In the saturated lamps considered, which are designed as lamps for vehicle headlights, the region of the lamp bulb is heated in an undifferentiated manner. It is mainly this heating which leads to an intensified evaporation of metal halides in the interior of the lamp bulb at the prevailing operating temperatures of the lamp, in particular owing to heat conduction and convection.

Transposing the suggested solution described above to high-pressure gas discharge lamps, in particular UHP lamps, is not possible in particular because of the widely varying operating temperatures of the individual lamp types. A comparable temperature increase of the lamp bulb, which has an operating temperature of approximately 1000° C., is incapable of providing a significant temperature increase of the plasma or discharge arc owing to heat conduction and convection, given the temperature of the discharge arc of an UHP lamp of approximately 6000 to 7000° C. It is typical of UHP lamps, moreover, that they emit only low luminous intensities in the IR range, unlike other lamp types.

If high-pressure gas discharge lamps, in particular UHP lamps, are to be used, two essential requirements are to be fulfilled at the same time.

On the one hand, the highest temperature at the inner surface of the discharge space must not become so high that a devitrification of the lamp bulb, usually made of quartz glass, takes place. This may be a problem because the strong convection inside the discharge space of the lamp heats the region above the discharge arc particularly strongly.

On the other hand, the coldest spot at the inner surface of the discharge space must still have a temperature so high that the mercury does not deposit there, but instead remains in the vapor state to a sufficient degree.

These two mutually conflicting requirements have the result that the maximum admissible difference between the highest and the lowest temperature is comparatively small. During operation of these high-pressure gas discharge lamps at the loading limit of the construction materials, any change in the temperature field, for example a temperature rise, may adversely affect the performance parameters, such as lamp life. This optimized system reacts very sensitively to measures which influence or change the temperature field in the discharge space. The provision of a reflecting layer on the outer surface represents such a measure.

A coating, for example a multilayer interference filter, in addition often leads to a reduction in the heat radiation from the lamp surface as compared with a non-coated quartz surface, so that the lamp can give off less heat and accordingly the operating temperature rises.

The interference filter is to be chosen such that the temperature field changes as little as possible with the use of the multilayer interference filter.

The invention accordingly has for its object to provide a high-pressure gas discharge lamp of the kind mentioned in the opening paragraph and a lighting unit comprising such a lamp, wherein the lamp bulb or burner has an interference filter which can be effectively manufactured in industrial mass production, such that the interference filter enhances the luminous efficacy of the lamp while the operational reliability of the lamp remains ensured.

The object of the invention is achieved by the characterizing features of claim 1.

The lamp according to the invention has at least a burner comprising a symmetrical discharge chamber, wherein at least the outer contour of the burner has an elliptical shape in the region of the discharge chamber, two electrodes extending into the discharge chamber and arranged in mutual opposition on the major axis of symmetry of the discharge chamber, and a multilayer interference filter arranged on the outer contour of the burner in the region of the discharge chamber, wherein the interference filter reflects mainly light from at least one wavelength range of UV light into the space between the two electrodes.

If a significant reabsorption is to be achieved in the plasma or in the discharge arc, which is present substantially in the space between the two electrodes, it is necessary for the reflected UV light to travel from the interference filter directly into this space by radiation. Heat conduction and convection are much less important than energy transport by radiation and have substantially no influence on the relevant temperature increase of the discharge arc. The invention here utilizes the empirical result that substances or media exposed to electromagnetic waves by radiation absorb in particular those frequencies which they themselves are capable of radiating. This is also true for the plasma which is regularly present in the space between the two electrodes. For this reason, the interference filter does not reflect the entire UV wavelength range, but only one or several wavelength ranges therefrom in a selective manner. The selection of the relevant wavelength range of the UV light to be reflected by the interference filter is made in particular on the basis of energy considerations, i.e. the relevant wavelength range must have in particular sufficient power that can be absorbed in the plasma after reflection at the interference filter. A criterion for the interference filter is the necessary temperature stability and its suitability for industrial mass production.

Interference filters are preferably used for such reflectors because of the sharp transitions between the spectral ranges to be transmitted and to be reflected. A suitable design of the layer sequences renders it possible to achieve filter characteristics over wide ranges and with the necessary high accuracy.

This reabsorption by radiation represents an additional energy supply to the arc besides the electrical energy supply, thus serving for a renewed generation of the relevant luminous spectrum of the respective lamp type and providing visible light as a component thereof. This leads to the additional advantage that this energy enters the discharge arc with a higher degree of efficiency than via the electrodes, where not inconsiderable electrode losses are to be taken into account.

Subject to the sensitive temperature balance in UHP lamps, a corresponding reduction in the supply of electrical power is also possible, such that a corresponding rise in luminous efficacy is achieved. To what degree this reabsorption and conversion into desired spectral ranges can be realized depends in particular on the type of high-pressure gas discharge lamp in question.

If the interference filter is arranged on substantially the entire outer contour of the discharge chamber or burner, a larger portion of the reflected UV radiation can be utilized for reabsorption owing to multiple reflections as compared with an interference filter in the form of a partial coating.

The dependent claims relate to advantageous further embodiments of the invention.

It is preferred that a layer having a higher refractive index and a layer having a lower refractive index alternate in the layer structure of the multilayer interference filter.

Such interference filters are usually built up in multiple layers. Given a multilayer construction of the interference filter, layers of higher and layers of lower refractive index occur in alternation. The refractive index of a respective layer is defined in particular by the selected material of the layer, which implies that at least two dielectric materials differing in this respect are to be found in the layer arrangement.

The transmission and reflection properties of the filter are determined by the design of the individual layers of the filter, in particular the layer thicknesses thereof. In principle, a desired spectral target function can be realized better in proportion as the difference between the refractive indices of the individual layers of the filter is larger. Given a large difference between the refractive index values of the layer materials, it is often possible to reduce the number of alternating layers and thus the total thickness of the interference filter. The material for the layer of low refractive index is often $SiO_2$ in the case of lamp bulbs made from quartz or a similar material. The usual operating temperature range of UHP lamps is to be taken into account in the selection of the layer material having the higher refractive index, which temperature has an upper range of around 1000° C. A sufficient temperature resistance in this respect is found, for example, in zirconium oxide ($ZrO_2$). Zirconium oxide, however, has a considerably higher coefficient of thermal expansion than quartz. This may accordingly lead to a build-up of stresses between the layers of the interference filter at the high operating temperatures of high-pressure gas discharge lamps, in particular UHP lamps, which stresses may lead to cracks in the filter or even to the destruction thereof, or may cause an undesirably increased light scattering.

It is furthermore preferred that the light from those wavelength ranges of UV light that are not reflected by the interference filter is absorbed.

It is furthermore preferred that the interference filter of a UHP lamp mainly reflects UV light from the wavelength range from 335 to 395 nm into the region between the two electrodes.

The object of the invention is in addition achieved by a lighting unit as claimed in claim 8.

Further details, features, and advantages of the invention will become apparent from the ensuing description of a preferred embodiment which is given with reference to the drawing, in which:

FIG. 1 is a diagrammatic cross-sectional view of a lamp bulb of a high-pressure gas discharge lamp (UHP lamp) which supports a 17-layer interference filter.

FIG. 1 diagrammatically and in cross-section (FIG. 1.1) shows a lamp bulb 1 with a symmetrical discharge space 21 of a high-pressure gas discharge lamp (UHP lamp) according to the invention. The burner 2, which is formed from one integral piece, which hermetically encloses a discharge space 21 filled with a gas usual for this purpose, and whose material is usually hard glass or quartz glass, comprises two cylindrical, mutually opposed regions 22, 23 between which a substantially spherical region 24 with a diameter in a range of approximately 8 mm to 14 mm is present. The outer contour of the burner 2 in the region of the discharge chamber 21 has an elliptical shape. The elliptically shaped discharge space 21 with an electrode arrangement is centrally positioned in the region 24. The electrode arrangement substantially comprises a first electrode 41 and a second electrode 42, between whose mutually opposed tips a luminous discharge arc is excited in the discharge space 21, such that the discharge arc serves as a light source of the high-pressure gas discharge lamp. The ends of the electrodes 41, 42 arranged on the major axis of symmetry of the discharge chamber 21 are connected to electrical connection pins 51, 52 of the lamp via which a supply voltage necessary for lamp operation is supplied by means of a supply unit (not shown in FIG. 1.1) designed for connection to a mains voltage.

An interference filter 3 is provided on the entire outer surface of the region 24. The interference filter 3 has a total thickness of approximately 1 μm and comprises a plurality of layers. The design of the interference filter 3, or its construction, is visible in FIG. 1.2. The interference filter 3 is built up from 17 layers, wherein the total layer thickness of the $SiO_2$ layers is approximately 674.9 mm and the total thickness of the $ZrO_2$ layers is approximately 305.8 μnm.

The two individual layers 3.1 and 3.2 of the interference filter 3 are characterized in particular by their differing indices of refraction, such that a layer of low index alternates with a layer of higher index each time. The material for the layer 3.2 of lower refractive index is $SiO_2$; the material for the layer 3.1 of higher refractive index is $ZrO_2$.

The interference filter 3 reflects mainly UV light from the wavelength range from 335 to 395 nm with a reflectivity of more than 90% into the region between the two electrodes 41 and 42.

The layer-by-layer application of the interference filter 3 takes place in a manufacturing process by means of a sputtering method that is known per se.

No detrimental effects in excess of the normal ageing of comparable lamps could be observed for a UHP lamp with the lamp bulb 1 described above and operated at a rated power of 120 W, also after several thousands of hours of operation at the loading limit, i.e. at the high-load point.

The UHP lamp according to the invention was tested at a power consumption of 120 W for its photometric and electrical properties in a standard test procedure in an Ulbricht sphere photometer. The radiant power in the UV range (approximately 200 to 400 nm) was 1.33 W and in the visible range (approximately 400 to 780 mn) 31.2 W. Given a quantity of light of 7918 lm, the luminous efficacy was accordingly 66.2 lm/W.

A similar measurement of a comparable UHP lamp, but without the interference filter 3 described above, gave the following values. The radiant power in the UV range (approximately 200 to 400 nm) was 7.13 W and in the visible range (approximately 400 to 780 nm) 30.97 W. A light quantity of 7325 lm thus resulted in a luminous efficacy of 61.3 lm/W.

A particularly advantageous embodiment of the invention relates to a high-pressure gas discharge lamp used for projection purposes.

The invention claimed is:

1. A high-pressure discharge lamp comprising:

a burner having a symmetrical discharge chamber, where at least the outer contour of the burner has an elliptical shape in the region of the discharge chamber;

electrodes extending into the discharge chamber and arranged in mutual opposition on the major axis of symmetry of the discharge chamber;

a multilayer interference filter on the outer contour of the burner in the region of the discharge chamber, wherein the interference filter reflects light from at least one wavelength range of UV light into a space between the electrodes, and wherein the burner is an integral piece that hermetically encloses and defines the discharge chamber;

wherein a temperature of a discharge arc of the lamp is between 6000 and 7000° C.; and wherein light from those wavelength ranges of the UV light that are not reflected by the interference filter is absorbed.

2. A high-pressure discharge lamp as claimed in claim 1, wherein the interference filter has a first layer having a first refractive index and a second layer having a second refractive index, wherein the first refractive index is higher than the second refractive index, and wherein the first and second layers are positioned in alternation in the layer construction of the multilayer interference filter.

3. A high-pressure discharge lamp as claimed in claim 2, wherein the second layer of the interference filter comprises $SiO_2$, and wherein the first layer of the interference filter comprises zirconium oxide.

4. A high-pressure discharge lamp as claimed in claim 2, wherein the first layer comprises a material selected from the group of titanium oxide, tantalum oxide, niobium oxide, hafnium oxide, silicon nitride, and zirconium oxide, or a mixture of these materials.

5. A high-pressure discharge lamp as claimed in claim 1, wherein the interference filter reflects UV light limited to the wavelength range from 335 to 395 nm into the region between the electrodes.

6. A lighting unit comprising:

at least one gas discharge lamp having a burner with a discharge chamber, wherein at least the outer contour of the burner has an elliptical shape in the region of the discharge chamber;

electrodes extending into the discharge chamber and arranged in mutual opposition on the major axis of symmetry of the discharge chamber; and a multilayer interference filter on the outer contour of the burner in the region of the discharge chamber, wherein the interference filter reflects UV light limited to the wavelength range from 335 to 395 nm into a space between the electrodes; and wherein a temperature of a discharge arc of the lamp is between 6000 and 7000° C.

7. The lighting unit of claim 6, wherein the burner is an integral piece that hermetically encloses and defines the discharge chamber.

8. The lighting unit of claim 7, wherein the interference filter has a first layer having a first reflective index and a second layer having a second refractive index, wherein the first refractive index is higher than the second refractive index, and wherein the first and second layers are positioned in alternation in the layer construction of the multilayer interference filter.

9. The lighting unit of claim 8, wherein the second layer of the interference filter comprises $SiO_2$, and wherein the first layer of the interference filter comprises zirconium oxide.

10. The lighting unit of claim 8, wherein the first layer comprises a material selected from the group of titanium oxide, tantalum oxide, niobium oxide, hafnium oxide, silicon nitride, zirconium oxide, or a mixture of these materials.

11. A lighting unit comprising:

at least one gas discharge lamp having a burner surrounding a discharge chamber, wherein an outer contour of the burner has an elliptical shape in the region of the discharge chamber;

electrodes extending into the discharge chamber and arranged in mutual opposition on the major axis of symmetry of the discharge chamber; and a multilayer interference filter on the outer contour of the burner in the region of the discharge chamber, wherein the interference filter reflects UV light of a selected wavelength range into a space between the electrodes;

wherein a temperature of a discharge arc of the lamp is between 6000 and 7000° C.; and wherein light from those wavelength ranges of the UV light that are not reflected by the interference filter is absorbed.

12. The lighting unit of claim 11, wherein the interference filter reflects UV light limited to the wavelength range from 335 to 395 nm into the space between the electrodes.

13. The lighting unit of claim 11, wherein the burner is an integral piece that hermetically encloses and defines the discharge chamber.

14. The lighting unit of claim 11, wherein the interference filter has a first layer having a first reflective index and a second layer having a second refractive index, wherein the first refractive index is higher than the second refractive index, and wherein the first and second layers are positioned in alternation in the layer construction of the multilayer interference filter.

15. The lighting unit of claim 14, wherein the second layer of the interference filter comprises $SiO_2$, and wherein the first layer of the interference filter comprises zirconium oxide.

16. The lighting unit of claim 14, wherein the first layer comprises a material selected from the group of titanium oxide, tantalum oxide, niobium oxide, hafnium oxide, silicon nitride, zirconium oxide, or a mixture of these materials.

17. The lighting unit of claim 11, wherein the discharge chamber is defined between opposing cylindrical ends of the burner, and wherein the cylindrical ends do not have the interference layer thereon.

* * * * *